US009406282B2

(12) United States Patent
Gomez et al.

(10) Patent No.: US 9,406,282 B2
(45) Date of Patent: Aug. 2, 2016

(54) DISPLAY PROTECTION FOR INVALID TIMING SIGNALS

(71) Applicant: APPLE, INC., Cupertino, CA (US)

(72) Inventors: Jason N. Gomez, Campbell, CA (US); James C. Aamold, Campbell, CA (US); Sandro H. Pintz, Menlo Park, CA (US); Paolo Sacchetto, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 3 days.

(21) Appl. No.: 14/502,868

(22) Filed: Sep. 30, 2014

(65) Prior Publication Data

US 2015/0325212 A1 Nov. 12, 2015

Related U.S. Application Data

(60) Provisional application No. 61/992,099, filed on May 12, 2014.

(51) Int. Cl.

| | |
|---|---|
| ***G09G 5/18*** | (2006.01) |
| ***G09G 3/36*** | (2006.01) |
| ***G09G 3/32*** | (2016.01) |

(52) U.S. Cl.

CPC ..... *G09G 5/18* (2013.01); *G09G 3/3208* (2013.01); *G09G 3/3611* (2013.01)

(58) Field of Classification Search

None

See application file for complete search history.

(56) References Cited

U.S. PATENT DOCUMENTS

| | | | | |
|---|---|---|---|---|
| 5,703,629 | A | 12/1997 | Mermelstein et al. | |
| 6,483,447 | B1 * | 11/2002 | Eglit | G09G 5/008 341/111 |
| 6,972,741 | B1 | 12/2005 | Isono et al. | |
| 8,179,360 | B2 | 5/2012 | Chin | |
| 8,390,614 | B2 | 3/2013 | Fan et al. | |
| 2011/0018845 | A1 * | 1/2011 | Mizunaga | G09G 3/3677 345/204 |
| 2012/0139882 | A1 * | 6/2012 | Kim | G09G 5/008 345/204 |
| 2013/0253860 | A1 * | 9/2013 | Kim | G02F 1/1309 702/58 |
| 2015/0130822 | A1 * | 5/2015 | Lee | G09G 3/20 345/520 |

OTHER PUBLICATIONS

NEC MultiSync PA231W, MultiSync PA241W, MultiSync PA271W, MultiSync PA301W User's Manual; Oct. 2005; 42 pgs.

* cited by examiner

*Primary Examiner* — Joseph Haley
*Assistant Examiner* — Emily Frank
(74) *Attorney, Agent, or Firm* — Fletcher Yoder PC

(57) ABSTRACT

A device includes a timing test circuit. The timing test circuit receives a timing signal related to the display of an image on a display. The timing test circuit also determines if the timing signals are invalid. Moreover, the timing test circuit transmits a fault indication when the timing signals are determined to be invalid.

17 Claims, 13 Drawing Sheets

DISPLAY PROTECTION FOR INVALID TIMING SIGNALS

CROSS REFERENCE TO RELATED APPLICATIONS

This application is a Non-Provisional Application claiming priority to U.S. Provisional Patent Application No. 61/992,099, entitled "Display Protection for Invalid Timing Signals", filed May 12, 2014, which is herein incorporated by reference.

BACKGROUND

The present disclosure relates generally to electronic displays and, more particularly, to detection of errors in display source timings.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic displays, such as liquid crystal displays (LCDs) and organic light emitting diode (OLED) displays, are commonly used in electronic devices such as televisions, computers, and phones. The electronic displays display images when image data is sent by a timing controller (TCON) to display drivers in the electronic display. Oftentimes, these displays may be set up to operate with fixed timings of the TCON to allow for proper operation of the device. However, there are occasions wherein a user or program may attempt to alter the timing signals. Unfortunately, alteration of the timing signals of the TCON can lead to excess current draws in the display as well as the generation of screen abnormalities that may last minutes, hours, or even days. Accordingly, it would be desirable to eliminate the occurrence of these abnormalities.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Embodiments of the present disclosure relate to devices and methods for detecting invalid timing signals for a display of an electronic device. Additionally, techniques are presented that notify when a fault has occurred. Furthermore, techniques and devices are presented that undertake steps to prevent damage to the display when invalid timing signals are detected, for example, by entering the display into a safe mode whereby the invalid timing signals are not transmitted to the display. Instead, predetermined values that are non-detrimental to the operation of the display may be transmitted to the display when invalid timing signals are detected.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Figure 1:
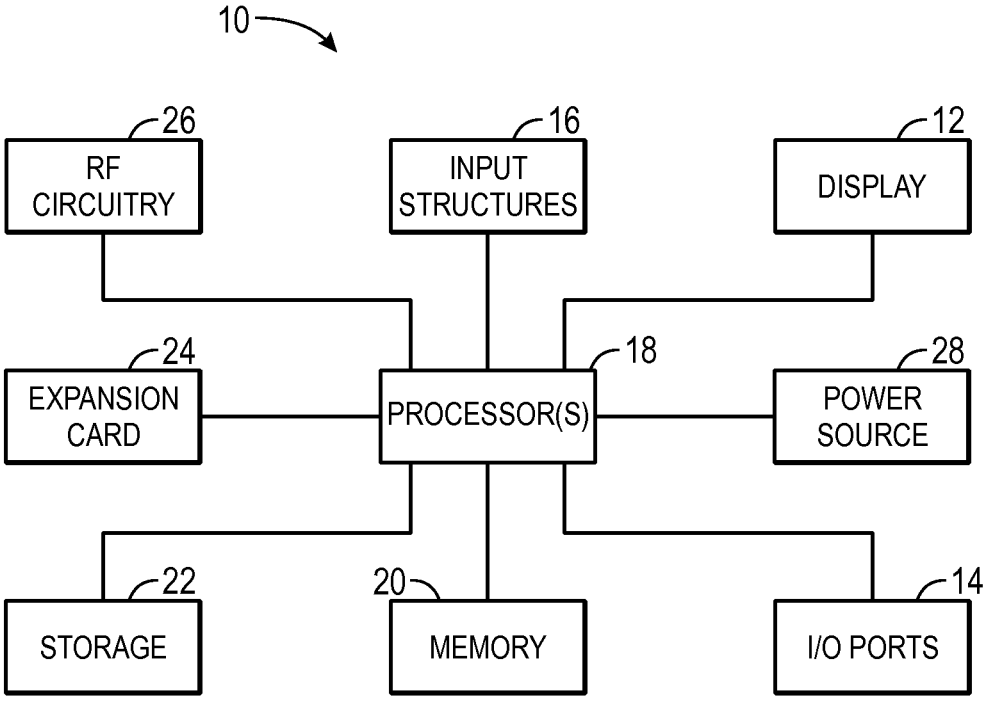
FIG. 1 illustrates a block diagram of an electronic device that may use the techniques disclosed herein, in accordance with aspects of the present disclosure.

With the foregoing in mind, it is useful to begin with a general description of suitable electronic devices that may employ the display devices and techniques described below. In particular, FIG. 1 is a block diagram depicting various components that may be present in an electronic device suitable for use with such display devices and techniques. FIGS. 2, 3, 4, and 5 illustrate front and perspective views of suitable electronic devices, which may be, as illustrated, a handheld electronic device, a tablet computing device, a notebook computer, or a desktop computer.

As mentioned briefly above, timing signals for a display may on occasion be compromised. To prevent damage to the display that may occur when a display receives improper or invalid timing signals, devices and techniques outlined below may be employed to detect invalid timing signals and to take specific actions when invalid timing signals are detected to reduce the potential for faults to be generated on a display. In some embodiments, these actions include transmitting known safe values to a display in place of invalid timing signals. Additionally, indications of the invalid signals may be generated and transmitted to the device providing the timing signals to the display, e.g., a timing controller or a processor providing signals to the timing controller.

Turning first to FIG. 1, an electronic device 10 according to an embodiment of the present disclosure may include, among other things, a display 12, input/output (I/O) ports 14, input structures 16, one or more processor(s) 18, memory 20, nonvolatile storage 22, an expansion card 24, RF circuitry 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in the electronic device 10.

Figure 2:
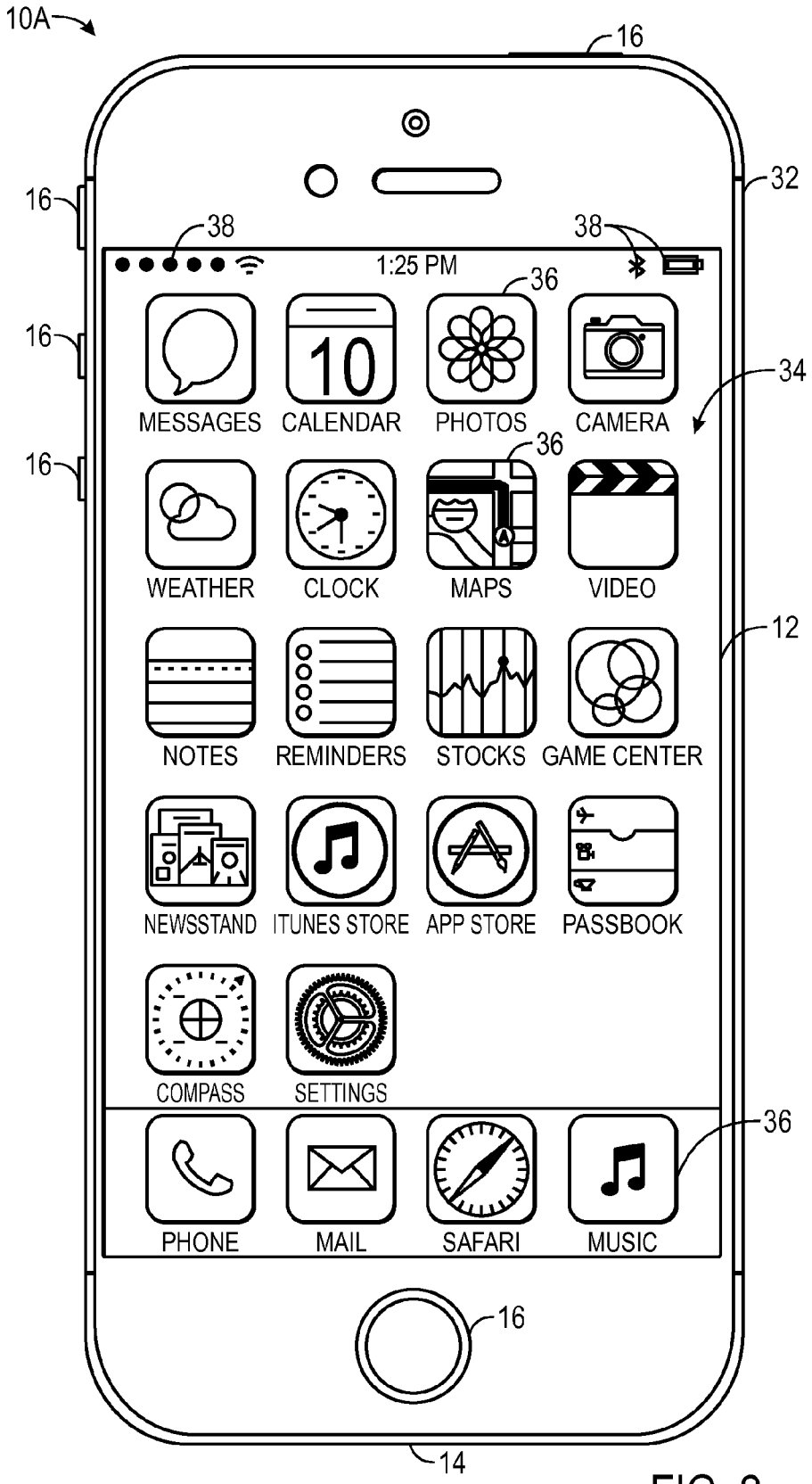
FIG. 2 illustrates a front view of a handheld device, such as an iPhone, representing another embodiment of the electronic device of FIG. 1, in accordance with an embodiment.
Figure 3:
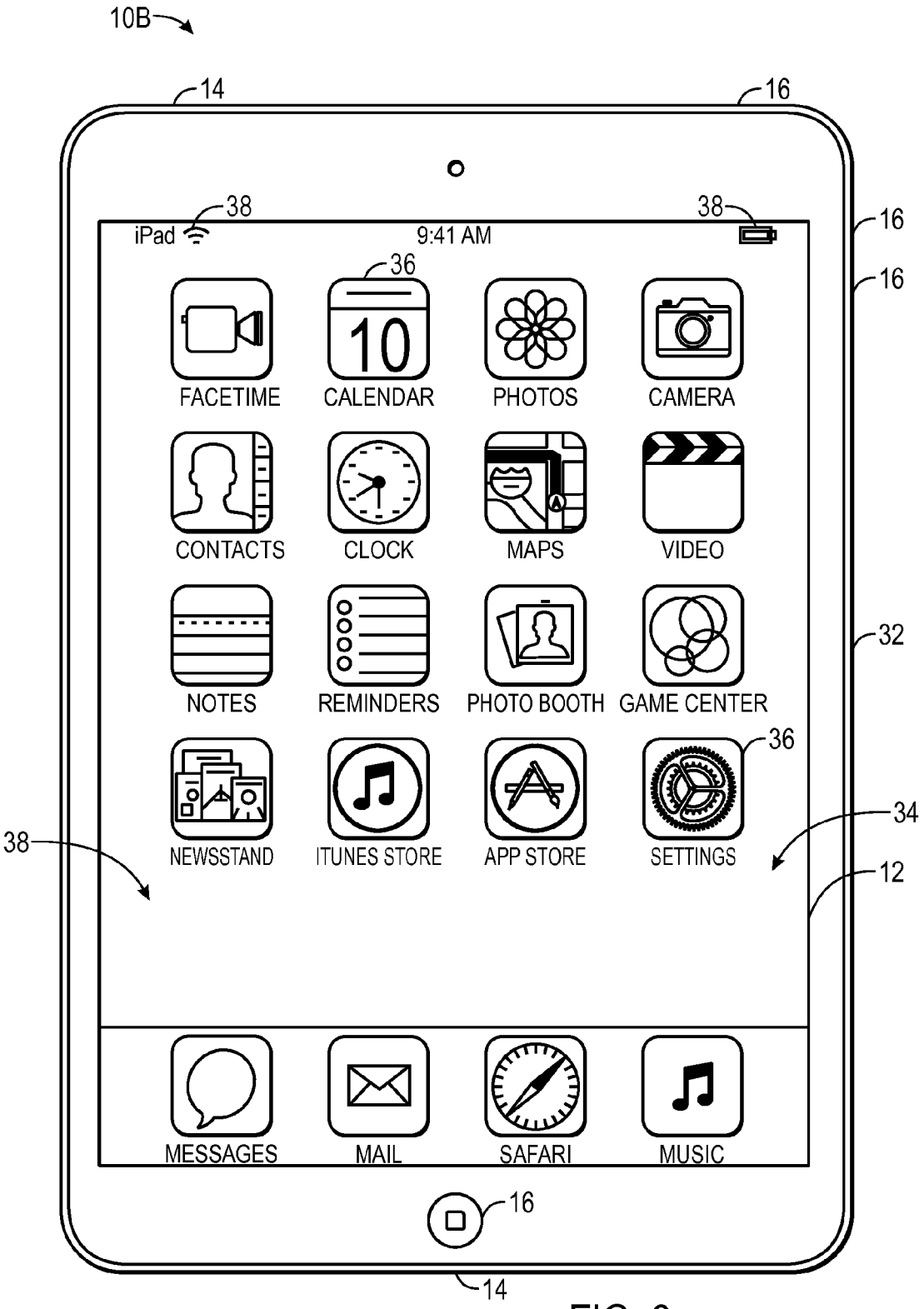
FIG. 3 illustrates a front view of a tablet device, such as an iPad, representing a further embodiment of the electronic device of FIG. 1, in accordance with an embodiment.
Figure 4:
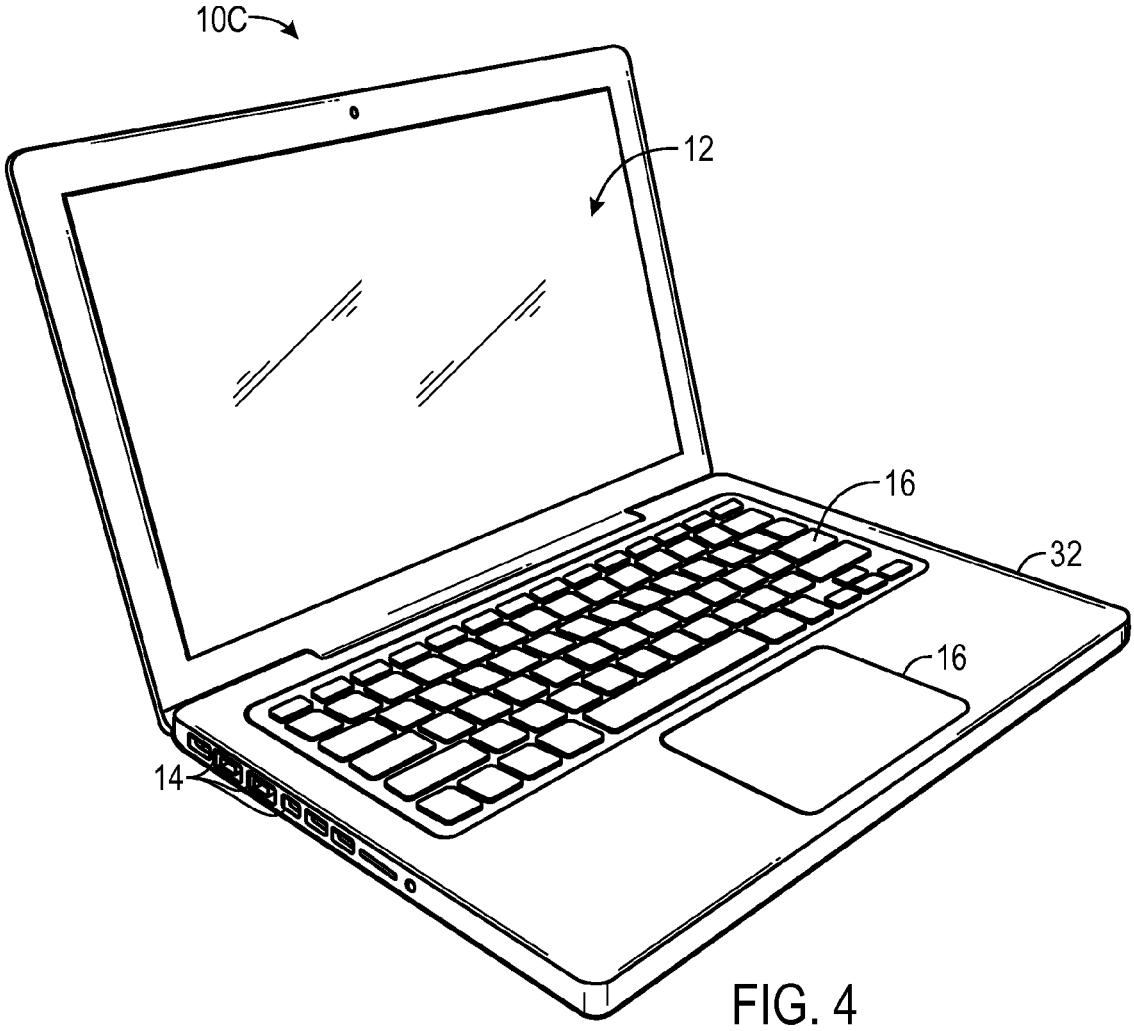
FIG. 4 illustrates a front view of a laptop computer, such as a MacBook, representing an embodiment of the electronic device of FIG. 1, in accordance with an embodiment.
Figure 5:
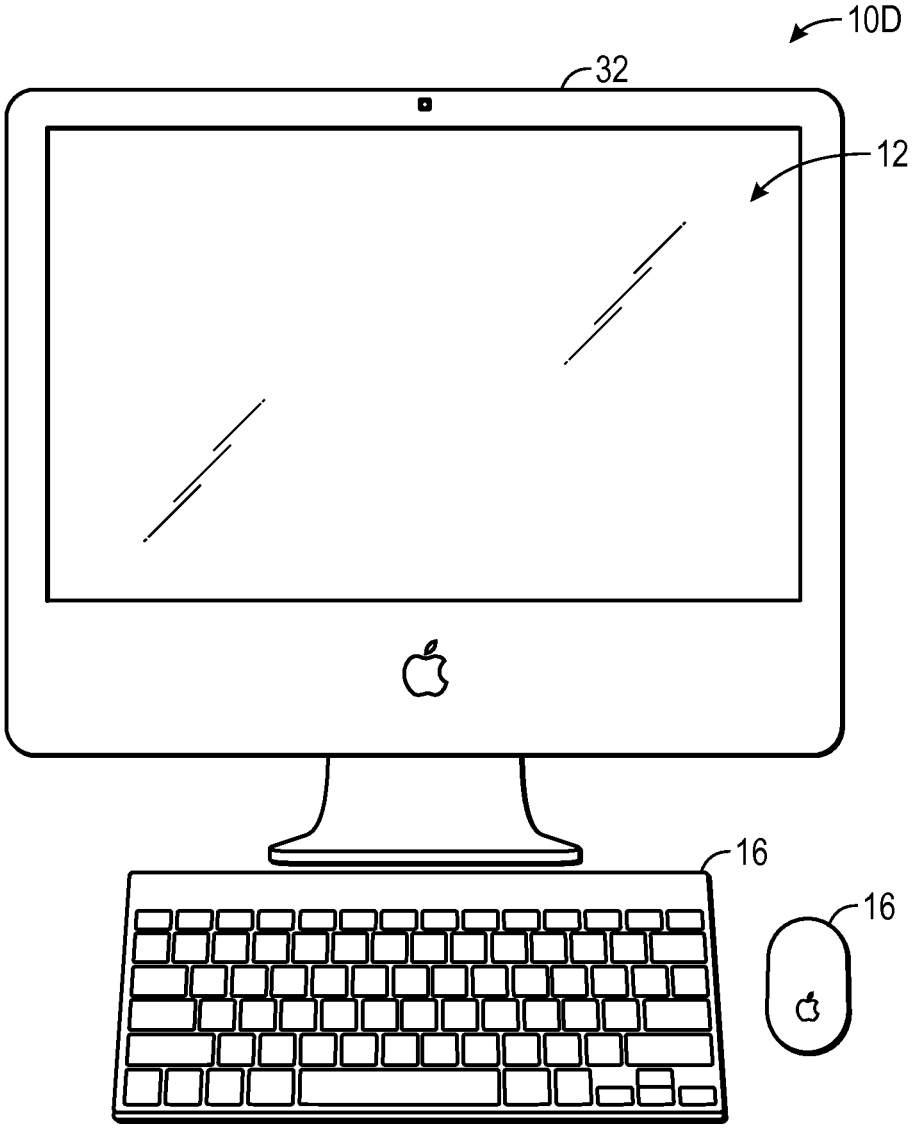
FIG. 5 illustrates a front view of a desktop computer, such as an iMac, representing another embodiment of the electronic device of FIG. 1, in accordance with an embodiment.

By way of example, the electronic device 10 may represent a block diagram of the handheld device depicted in FIG. 2, the tablet computing device depicted in FIG. 3, the notebook computer depicted in FIG. 4, the desktop computer depicted in FIG. 5, or similar devices, such as televisions, and so forth. It should be noted that the processor(s) 18 and/or other data processing circuitry may be generally referred to herein as "data processing circuitry." This data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor(s) 18 and/or other data processing circuitry may be operably coupled with the memory 20 and the nonvolatile storage 22 to execute instructions. Such programs or instructions executed by the processor(s) 18 may be stored in any suitable article of manufacture that includes one or more tangible, non-transitory computer-readable media at least collectively storing the instructions or routines, such as the memory 20 and the nonvolatile storage 22. The memory 20 and the nonvolatile storage 22 may include any suitable articles of manufacture for storing data and executable instructions, such as random-access memory, read-only memory, rewritable flash memory, hard drives, and optical discs. Also, programs (e.g., an operating system) encoded on such a computer program product may also include instructions that may be executed by the processor(s) 18.

The display 12 may be a touch-screen liquid crystal display (LCD), for example, which may enable users to interact with a user interface of the electronic device 10. In some embodiments, the electronic display 12 may be a MultiTouch™ display that can detect multiple touches at once.

The input structures 16 of the electronic device 10 may enable a user to interact with the electronic device 10 (e.g., pressing a button to increase or decrease a volume level). The I/O ports 14 may enable electronic device 10 to interface with various other electronic devices, as may the expansion card 24 and/or the RF circuitry 26. The expansion card 24 and/or the RF circuitry 26 may include, for example, interfaces for a personal area network (PAN), such as a Bluetooth network, for a local area network (LAN), such as an 802.11x Wi-Fi network, and/or for a wide area network (WAN), such as a 3G or 4G cellular network. The power source 28 of the electronic device 10 may be any suitable source of power, such as a rechargeable lithium polymer (Li-poly) battery and/or an alternating current (AC) power converter.

As mentioned above, the electronic device 10 may take the form of a computer or other type of electronic device. Such computers may include computers that are generally portable (such as laptop, notebook, and tablet computers) as well as computers that are generally used in one place (such as conventional desktop computers, workstations and/or servers). FIG. 2 depicts a front view of a handheld device 10A, which represents one embodiment of the electronic device 10. The handheld device 10A may represent, for example, a portable phone, a media player, a personal data organizer, a handheld game platform, or any combination of such devices. By way of example, the handheld device 10A may be a model of an iPod® or iPhone® available from Apple Inc. of Cupertino, Calif.

The handheld device 10A may include an enclosure 32 to protect interior components from physical damage and to shield them from electromagnetic interference. The enclosure 32 may surround the display 12, which may include a screen 34 for displaying icons 36. The screen 34 may also display indicator icons 38 to indicate, among other things, a cellular signal strength, Bluetooth connection, and/or battery life. The I/O ports 14 may open through the enclosure 32 and may include, for example, a proprietary I/O port from Apple Inc. to connect to external devices.

User input structures 16, in combination with the display 12, may allow a user to control the handheld device 10A. For example, the input structures 16 may activate or deactivate the handheld device 10A, navigate a user interface to a home screen, navigate a user interface to a user-configurable application screen, activate a voice-recognition feature of the handheld device 10A, provide volume control, and toggle between vibrate and ring modes. The electronic device 10 may also be a tablet device 10B, as illustrated in FIG. 3. For example, the tablet device 10B may be a model of an iPad® available from Apple Inc.

In certain embodiments, the electronic device 10 may take the form of a computer, such as a model of a MacBook®, MacBook® Pro, MacBook Air®, iMac®, Mac® mini, or Mac Pro® available from Apple Inc. By way of example, the electronic device 10, taking the form of a notebook computer 10C, is illustrated in FIG. 4 in accordance with one embodiment of the present disclosure. The depicted computer 10C may include a housing 32, a display 12, I/O ports 14, and input structures 16. In one embodiment, the input structures 16 (such as a keyboard and/or touchpad) may be used to interact with the computer 10C, such as to start, control, or operate a GUI or applications running on computer 10C. For example, a keyboard and/or touchpad may allow a user to navigate a user interface or application interface displayed on the display 12. The electronic device 10 may also take the form of a desktop computer 10D, as illustrated in FIG. 5. The desktop computer 10D may include a housing 32, a display 12, and input structures 16.

Figure 6:
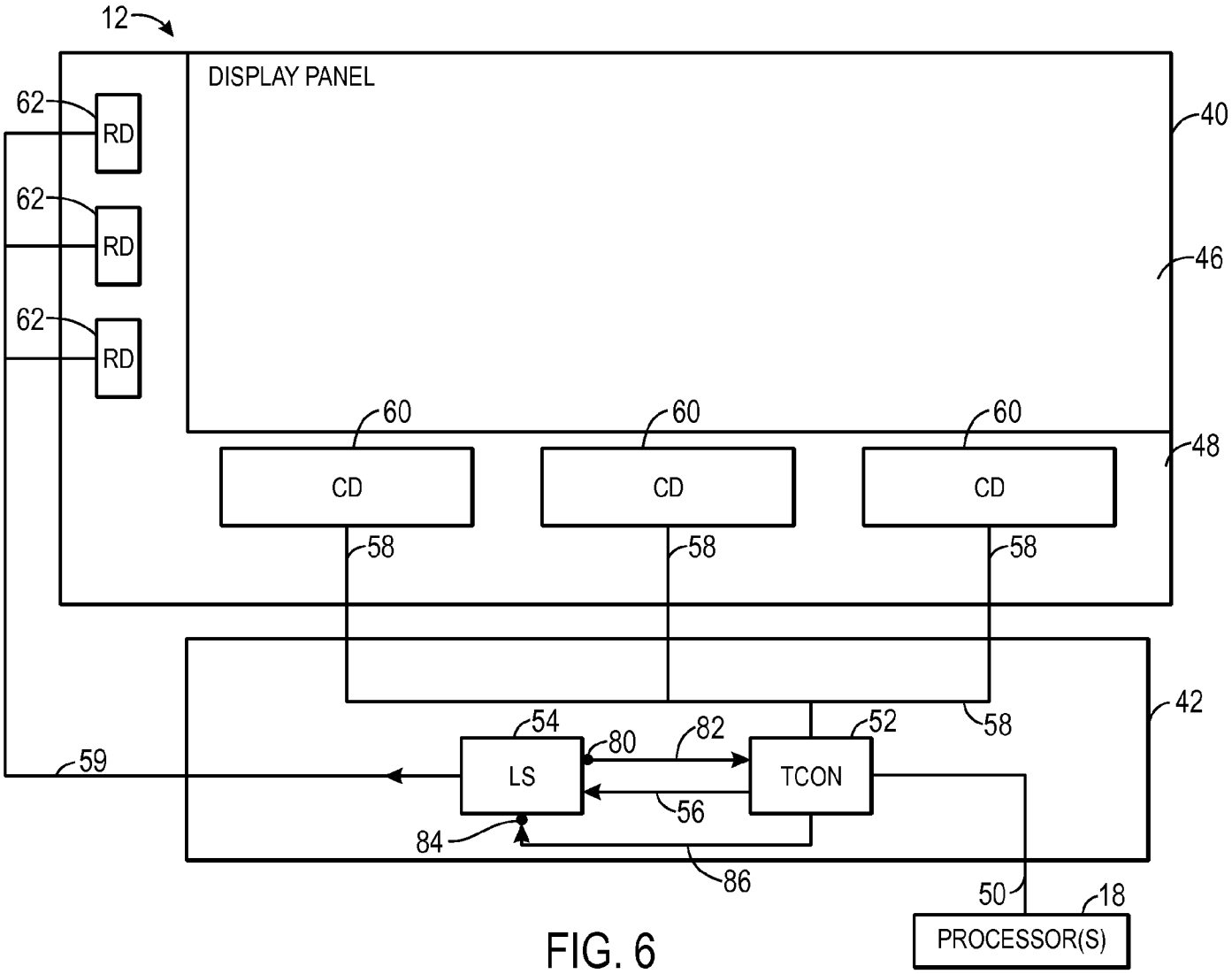
FIG. 6 is a block diagram of the electronic display of the electronic device of FIG. 1, in accordance with an embodiment.

FIG. 6 illustrates a display 12 that may be utilized in conjunction with any of the devices 10A, 10B, 10C, or 10D. As shown in FIG. 6, a display panel 40 of the display 18 may be communicably coupled to an electronic display interface 42 via any suitable interconnection. For example, flexible printed circuit (FPC) interconnections may be used to communicably couple the display panel 40 with the electronic display interface 42. The display panel 40 of the display 18 may include an active display area 46 having an array of pixels and display driver circuitry 46 that program the array of pixels.

To display images on active display area 46, a host (e.g., one or more of the processor(s) 18) may provide image data to the electronic display interface 42 via any suitable connector 50. For example, this connector 50 may be an Embedded Display Port (eDP) connector, an Internal Display Port (iDP) connector, a High-Definition Media Interface (HDMI) or Digital Visual Interface (DVI) connector, and/or a Mobile Industry Processor Interface (MIPI) connector.

In some embodiments, the electronic display interface 42 may include one or more elements that may receive the image data transmitted via connector 50 to the electronic display interface 42. For example, the electronic display interface 42 may include a timing controller (TCON) 52 and a level shifter (LS) 54. During operation of the display 18, the TCON 52 may receive image data signals from the processor(s) 12 and transmit the image data signals, via data path 56, to the LS 54. The LS 54 may, for example, convert the received timing signals from the TCON 52. This conversion may include amplification of the received timing signals to voltage levels suitable to drive the pixels of the active display area 46, for example, through the panel structures and along data line 59. However, is should be noted that in some embodiments, the LS 54 may be omitted and the TCON 52 may be directly coupled to data line 59 as well as to data lines 58.

Data lines 58 may couple the TCON 52 to the column drivers 60 of the display driver circuitry 48. The column drivers 60 may represent data drivers, of which the display 12 may include any suitable number. Though only three are illustrated in the schematic block diagram of FIG. 6, the display 12 may include more or fewer column drivers 60. Each of the column drivers 60 may program the image data signals onto a segment of the active display area 46.

Specifically, the column drivers 60 may operate in concert with row drivers 62 (having three elements as illustrative of various embodiments in general). As illustrated, the row drivers may receive signals along data line 59 from the LS 54. Additionally, a row driver 62 may activate one row of pixels of the active display area 46 and the column drivers 60 may respectively program one segment of the activated row of pixels with the image data. As the row drivers 62 activate successive rows of pixels, the column drivers 60 may successively program the activated pixels with the image data. As a result, images may be displayed on the active display area 46.

Figure 7:
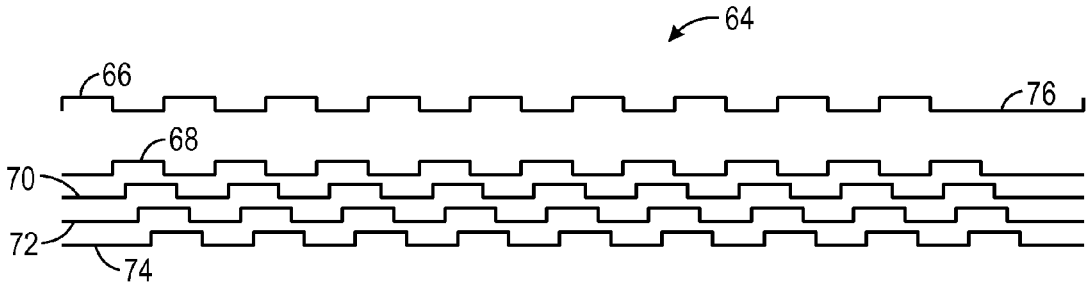
FIG. 7 is a first timing diagram related to the electronic display of the electronic device of FIG. 1, in accordance with an embodiment.
Figure 8:
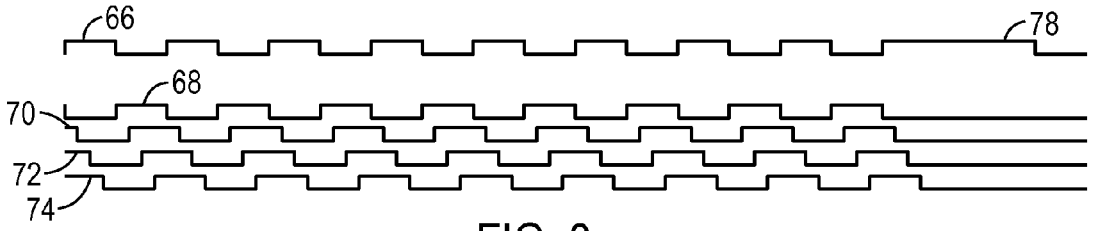
FIG. 8 is a second timing diagram related to the electronic display of the electronic device of FIG. 1, in accordance with an embodiment.

Typically, the display 12 is set up to operate via a fixed timing schedule provided by the TCON 52. However, certain operating conditions may trigger an invalid sequence as being transmitted from the TCON 52. For example, certain programs (e.g. games) may attempt to alter the timing schedule of the TCON 52 during game play. FIGS. 7 and 8 illustrate TCON 52 timings that include faults that may adversely impact the operation of display 12.

FIG. 7 illustrates a timing diagram 64 that includes an example of a timing output 66 of the TCON 52 as well as timing outputs 68, 70, 72, and 74 of the LS 54 generated based on the timing output of the TCON 52. As illustrated at 76, a fault in the timing output 66 of the TCON 52 is generated. For example, the output of the TCON 52 is driven low for a duration greater than the timing of the remainder of timing output 66. Likewise, FIG. 8 illustrates a fault 78 in the timing output 66 of the TCON 52. Fault 78 illustrates the output of the TCON 52 is driven high for a duration greater than the timing of the remainder of timing output 66. Either fault 76 of FIG. 7 or fault 78 of FIG. 8 may cause electrical stresses to be imparted to display 12 which may impact the operability of the display 12. Thus, detection and resolution of faults 76 and 78 would lead to reduced faults as well as reduced component failures in display 12.

Figure 9:
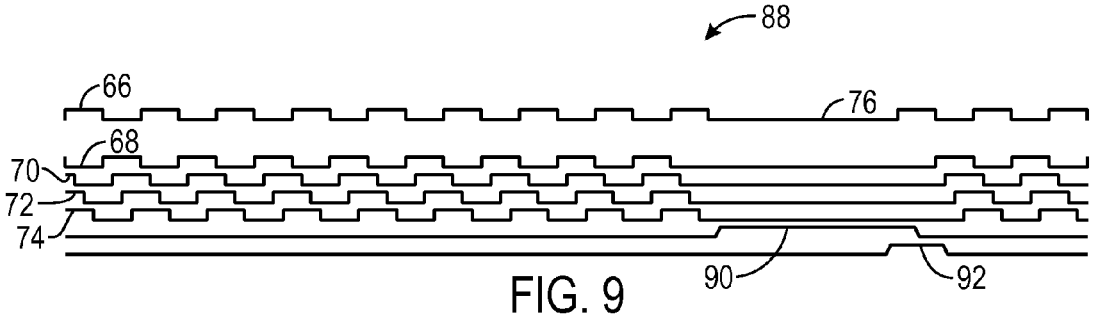
FIG. 9 is a third timing diagram related to the electronic display of the electronic device of FIG. 1, in accordance with an embodiment.
Figure 10:
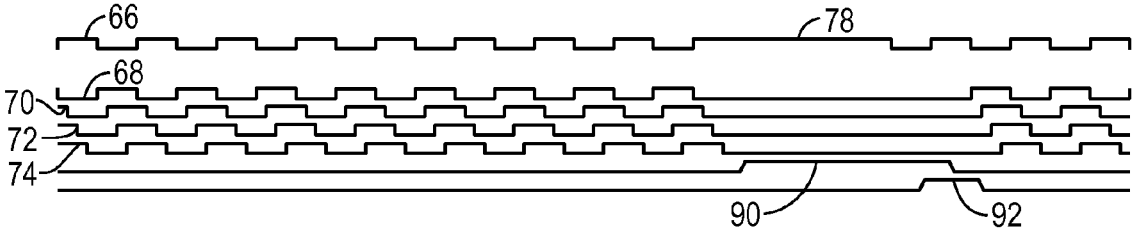
FIG. 10 is a fourth timing diagram related to the electronic display of the electronic device of FIG. 1, in accordance with an embodiment.

Returning to FIG. 6, a technique for identifying and reducing the impact of faults 76 and 78 is set forth. More specifically, the LS 54 may detect the faults 76 and 78 in one or more signals received from the TCON 52. Additionally, the LS 54 may include an output 80 coupled to data path 82 that transmits an indication that a fault condition has occurred to the TCON 52. Additionally, the LS 54 may include a reset or clear input 84 that allows for the resetting or clearing of the LS 54 by, for example, the TCON 52 along path 86 upon the termination of an invalid set of TCON 52 signals. FIGS. 9 and 10 illustrate examples of timing diagrams that illustrate detection of faults 76 and 78, as well as preventative steps undertaken upon detection of the faults 76 and 78 to reduce detrimental impacts to display 12 that might occur if the faults 76 and 78 and the signals related thereto were transmitted to the active display area 46.

Similar to FIG. 7 above, FIG. 9 illustrates timing diagram 88 that includes an example of a timing output 66 of the TCON 52 as well as timing outputs 68, 70, 72, and 74 of the LS 54 generated based on the timing output of the TCON 52. As illustrated at 76, a fault in the timing output 66 of the TCON 52 is generated. For example, the output of the TCON 52 is driven low for a duration greater than the timing of the remainder of timing output 66. However, FIG. 9 illustrates that this fault 76 is detected by the LS 54. In response to this detected fault 76, an indication 90 of the detected fault 76 is generated, e.g., for transmission from output 80 of LS 54. Likewise, in response to the detection of fault 76, the LS 54 may enter a safe output state wherein the outputs 68, 70, 72, and 74 of LS 54 are all set to one or more predetermined levels during the safe mode, as illustrated in FIG. 9.

In some embodiments, these predetermined levels of the safe output state may cause the generation of a black colored screen on display 12 as a safe mode of operation of the display 12. Alternatively, these predetermined levels of the safe output state may cause the generation of a white colored (or any colored or patterned) screen on display 12, or an error message to be displayed on display 12 as a safe mode of operation of the display 12. This safe mode may continue until, for example, a clear signal 92 is received, for example, at clear input 84 to reset or clear the LS 54 by, for example, the TCON 52. This may allow for renewed transmission of outputs 68, 70, 72, and 74 based upon timing output 66 of the TCON 52.

Likewise, FIG. 10 illustrates a fault 78 in the timing output 66 of the TCON 52 whereby the output of the TCON 52 is driven high for a duration greater than the timing of the remainder of timing output 66. However, FIG. 10 illustrates that this fault 78 is detected by the LS 54. In response to this detected fault 78, an indication 90 of the detected fault 78 is generated, e.g., for transmission from output 80 of LS 54. Likewise, in response to the detection of fault 78, the LS 54 may enter a safe output state wherein the outputs 68, 70, 72, and 74 of LS 54 are all set to one or more predetermined levels, similar to that described above with respect to FIG. 9. This may be a safe mode and may continue until, for example, a clear signal 92 is received, for example, at clear input 84 to reset or clear the LS 54 by, for example, the TCON 52. This may allow for renewed transmission of outputs 68, 70, 72, and 74 based upon timing output 66 of the TCON 52.

Figure 11:
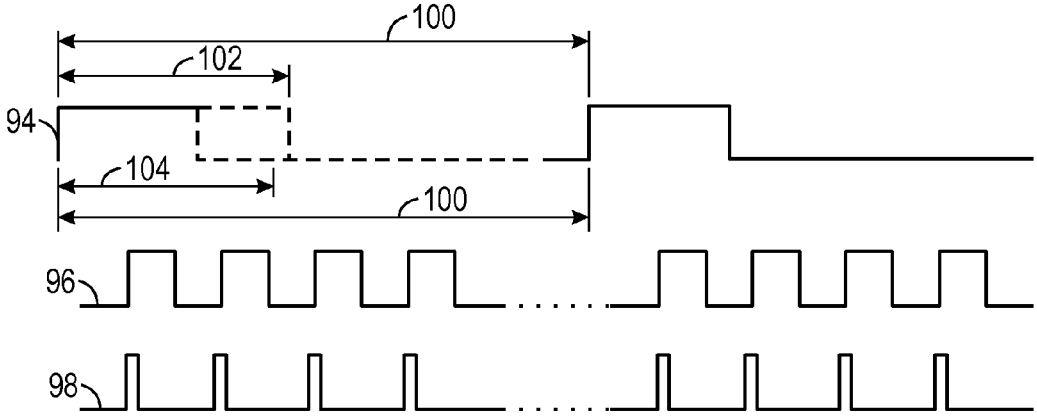
FIG. 11 is a fifth timing diagram related to the electronic display of the electronic device of FIG. 1, in accordance with an embodiment.

FIG. 11 is a timing diagram illustrating one embodiment of the operation of the LS 54 in greater detail. As illustrated in FIG. 11, the LS 54 may receive a start of frame signal 94, a gate clock timing signal 96, and an output enable signal 98. In some embodiments, the start of frame signal 94 may represent a timing signal to initiate a start of frame for the display 12. For example, the start of frame signal 94 may be analogous to the refresh rate of the display 12. In this manner, for a display 12 having a refresh rate of 60 Hz, the start of frame signal 94 would rise each 16.6 ms. That is, the amount of time 100 between start of frame signal 94 high pulses may be the refresh rate of the display 12.

In some embodiments, the gate clock timing signal 96 may represent gate clock timing of the display 12. Thus, each clock cycle of the gate clock timing signal 96 may represent one physical line on the display 12. Thus, for example, a gate clock timing signal 96 having 1440 pulses would correspond to display having a 1440 line resolution. Additionally, in some embodiments, output enable signal 98 represents the signal that is utilized by the display 12 to allow each line of the display 12 to be refreshed with new source driver data. Typically, the output enable signal 98 will have an equal number of pulses as the gate clock timing signal 96.

Additionally illustrated in FIG. 11 are an amount of time 102 and an amount of time 104. In some embodiments, the amount of time 102 may correspond to the maximum allowable time that the start of frame signal 94 may be high. Similarly, the amount of time 104 may correspond to an amount of time during which a set number of clock timing signal 96 pulses or output enable signal 98 pulses may occur (while the start of frame signal 94 is high). As described below, the amount of time 100, 102, and 104 may be utilized to determine if the respective signals 94, 96, or 98 are invalid.

Figure 12:
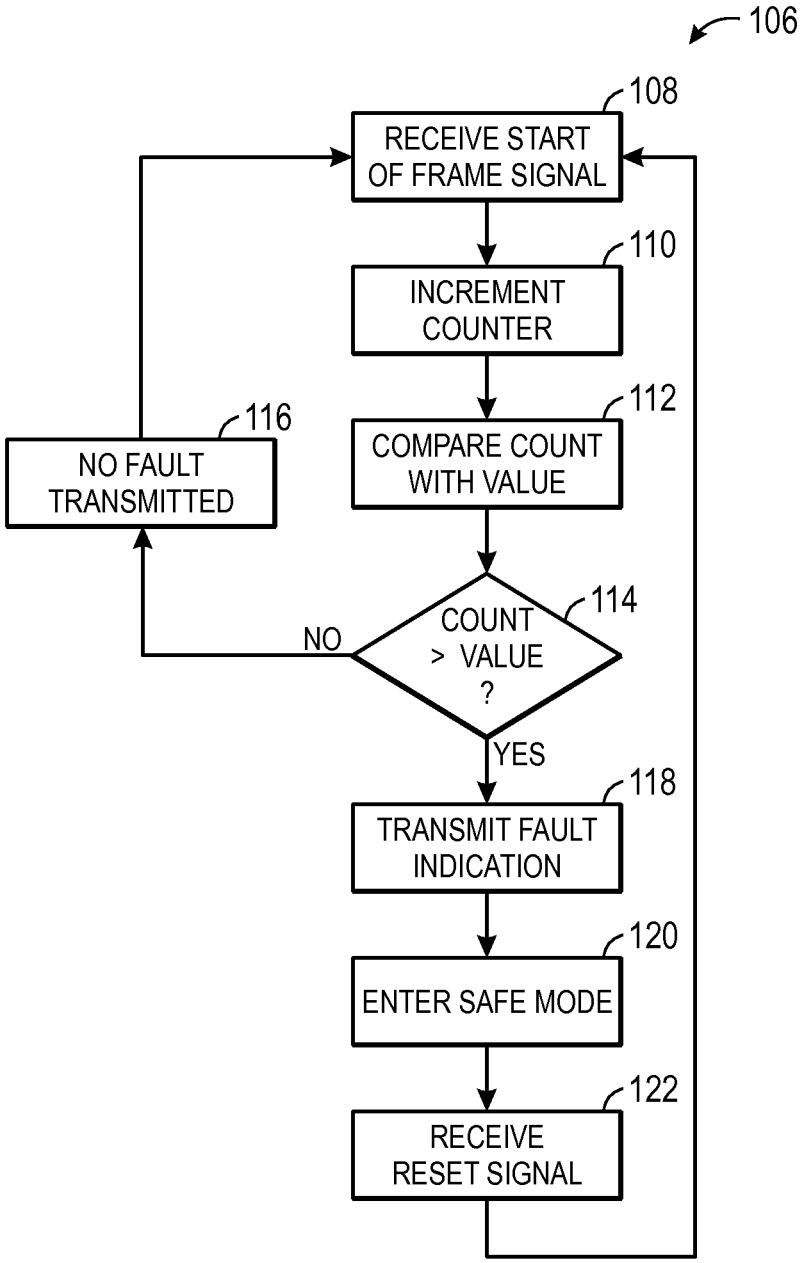
FIG. 12 is a flow chart illustrating a first timing signal validation detection technique of the level shifter of FIG. 6, in accordance with an embodiment.

FIG. 12 is a flow chart 106 illustrating a first timing signal detection validation technique of the present display 12. In one embodiment, the LS 54 may receive the start of frame signal 94 and increment a counter (e.g., present in the LS 54) at step 108. In step 110, the LS 54 may increment the counter each time a start of frame signal 94 is received for a period of time equal to amount of time 100 so as to measure the number of start of frame signal 94 high (e.g., "on") pulses for a single refresh period, e.g., a refresh rate check. In some embodiments, this amount of time may be preset and may be accumulated via an independent clock signal separate from the start of frame signal 94 (e.g., internally generated in the LS 54 via a clock or received from an external clock by the LS 54). In step 112, when the amount of time 100 has expired, the LS 54 may compare the value of the counter with a start of frame limit value that may be, for example, a preset value stored in memory in (or accessible by) the LS 54.

In step 114, if the counter value is less than or equal to the preset limit value, no fault signal is transmitted from the output 80 of the LS 54 to the TCON 52 in step 116 and the LS 54 may restart the process illustrated by flow chart 106. However, if the counter value is greater than the preset limit value in step 114, a fault signal (e.g., indication 90) is transmitted from the output 80 of the LS 54 to the TCON 52 in step 118. Additionally, the LS 54 may enter a safe mode in step 120 whereby all outputs transmitted from LS 54 along data lines 58 are set to one or more predetermined values. These values may continue to be transmitted from the LS 54 until a clear or reset signal is received from the TCON 52 at input 84, in step 122. Subsequent to receipt of this clear or reset signal, the LS 54 may restart the process illustrated by flow chart 106.

Figure 13:
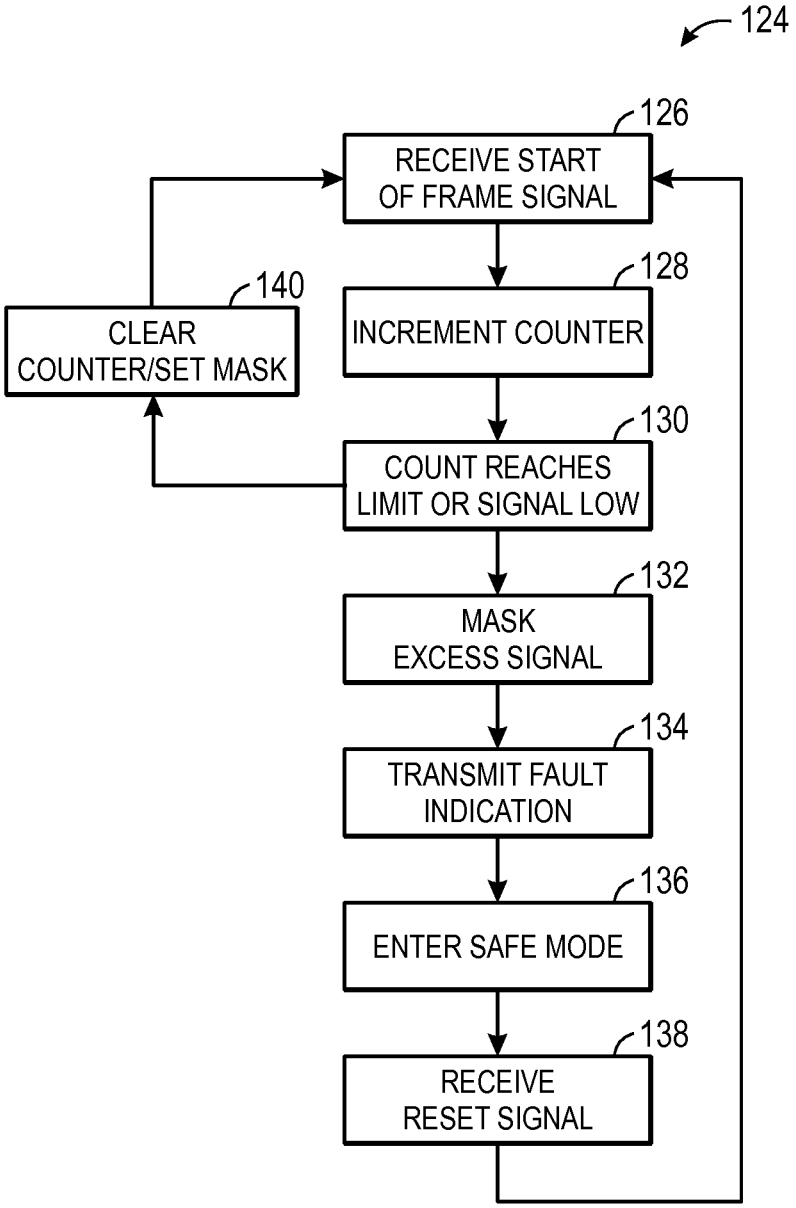
FIG. 13 is a flow chart illustrating a second timing signal validation detection technique of the level shifter of FIG. 6, in accordance with an embodiment.

FIG. 13 is a flow chart 124 illustrating a second timing signal detection validation technique of the present display 12. In one embodiment, the LS 54 may receive the start of frame signal 94 and increment a counter (e.g., present in the LS 54) at step 126. In step 128, the LS 54 may increment the counter each time a start of frame signal 94 is received for a period of time equal to amount of time 102. That is, for example, in step 128 the amount of time that the start of frame signal 94 is "on" (e.g., high) is measured and compared to, for example, a period of time equal to amount of time 102 to determine the pulse width of the start of frame signal 94.

In some embodiments, this amount of time may be preset and may be accumulated via an independent clock signal separate from the start of frame signal 94 (e.g., internally generated in the LS 54 via a clock or received from an external clock by the LS 54). In step 130, the LS 54 determines whether the start of frame signal 94 transitioned low during the predetermined time (e.g., time 102) or whether the start of frame signal 94 exceeded the time in which the start of frame signal 94 was scheduled to transition low. For example, this may be accomplished by determining whether the counter value (determined by counter increments based upon the independent clock signal) exceeds its preset limit so as to determine the width of the "on" pulse of the start of frame signal 94.

In one embodiment, in step 132, if the counter value exceeds its limit, the portion of the width of the "on" pulse of the start of frame signal 94 that exceeds an allowable number may be truncated (e.g., mask set to 0) so that the remaining truncated start of frame signal 94 meets any requirements for pulse width for the display 12. This may be selected as an option via an enable input that may selectively "correct" start of frame signals 94 that include pulse widths that are too wide for proper use by the display 12, for example, so that a pulse having too long of a positive width is not transmitted to display 12. It should be notes that step 132 may be elective, based on a preset enable input that enables or disables the functionality present in step 132.

In step 134, a fault indication may be transmitted if the start of frame signal 94 failed to transition low in a predetermined time, as discussed above. For example, a fault signal (e.g., indication 90) is transmitted from the output 80 of the LS 54 to the TCON 52 in step 134. Additionally, the LS 54 may enter a safe mode in step 136 whereby all outputs transmitted from LS 54 along data lines 58 are set to one or more predetermined values. These values may continue to be transmitted from the LS 54 until a clear or reset signal is received from the TCON 52 at input 84, in step 138. Subsequent to receipt of this clear or reset signal, the LS 54 may restart the process illustrated by flow chart 124. Additionally, when the start of frame signal 94 transitions low prior to the count reaching its limit, in step 140, the LS 54 may clear the counter and reset a mask value to high (e.g., 1) so as to prepare for to restart the process illustrated by flow chart 124.

Figure 14:
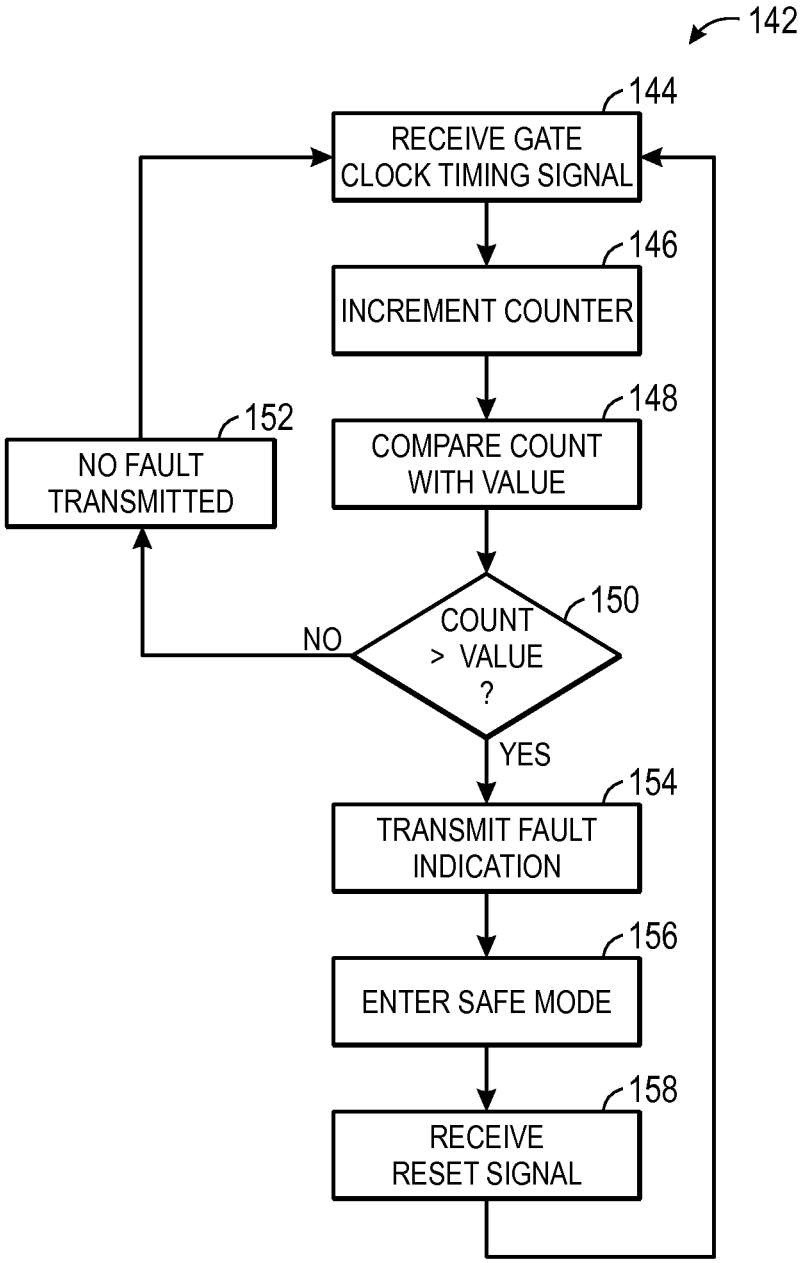
FIG. 14 is a flow chart illustrating a third timing signal validation detection technique of the level shifter of FIG. 6, in accordance with an embodiment.

FIG. 14 is a flow chart 142 illustrating a third timing signal detection validation technique of the present display 12. In one embodiment, the LS 54 may receive the gate clock timing signal 96 and increment a counter (e.g., present in the LS 54) at step 144. In step 146, the LS 54 may increment the counter each time a gate clock timing signal 96 is received for a period of time equal to amount of time 104 so as to measure the number of gate clock timing signal 96 pulses present while the start of frame signal 94 is high (e.g., "on"). In some embodiments, this amount of time may be preset and may be accumulated via an independent clock signal separate from the gate clock timing signal 96 (e.g., internally generated in the LS 54 via a clock or received from an external clock by the LS 54). In step 148, when the amount of time 104 has expired, the LS 54 may compare the value of the counter with a gate clock limit value that may be, for example, a preset value stored in memory in (or accessible by) the LS 54. In this manner, it may be determined whether multiple gate clock timing signal 96 "on" pulses occur during the period in which the start of frame signal 94 is high (e.g., "on").

In step 150, if the counter value is less than or equal to the preset limit value, no fault signal is transmitted from the output 80 of the LS 54 to the TCON 52 in step 152 and the LS 54 may restart the process illustrated by flow chart 142. However, if the counter value is greater than the preset limit value in step 150, a fault signal (e.g., indication 90) is transmitted from the output 80 of the LS 54 to the TCON 52 in step 154. Additionally, the LS 54 may enter a safe mode in step 156 whereby all outputs transmitted from LS 54 along data lines 58 are set to one or more predetermined values. These values may continue to be transmitted from the LS 54 until a clear or reset signal is received from the TCON 52 at input 84, in step 158. Subsequent to receipt of this clear or reset signal, the LS 54 may restart the process illustrated by flow chart 142. Moreover, it should be noted that the process illustrated by flow chart 142 may be implemented utilizing the output enable signal 98 in place of the gate clock timing signal 96.

Figure 15:
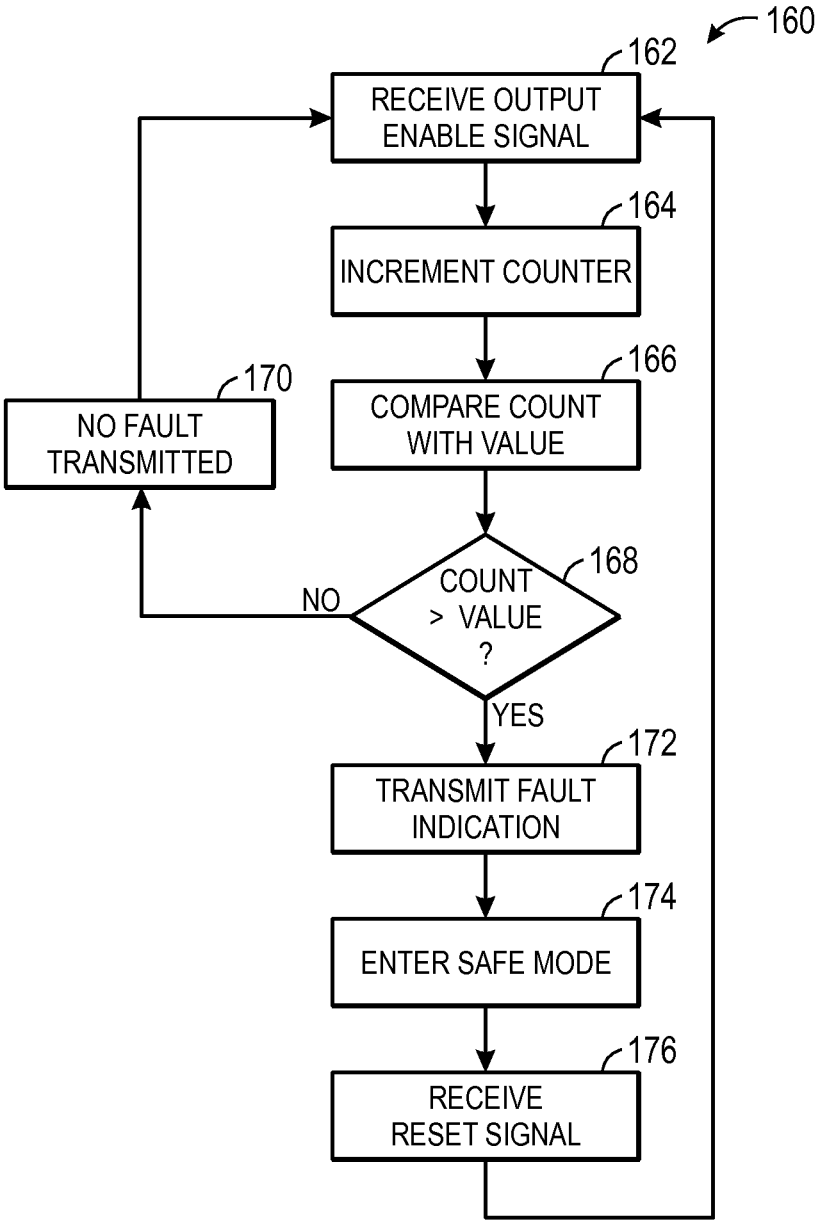
FIG. 15 is a flow chart illustrating a fourth timing signal validation detection technique of the level shifter of FIG. 6, in accordance with an embodiment.

FIG. 15 is a flow chart 160 illustrating a fourth timing signal detection validation technique of the present display 12. In one embodiment, the LS 54 may receive the gate clock timing signal 96 output enable signal 98 and increment a counter (e.g., present in the LS 54) at step 162. In step 164, the LS 54 may increment the counter each time an output enable signal 98 is received for a period of time equal to amount of time 100 so as to measure the number of gate clock timing signal 96 pulses present during a refresh period. In some embodiments, this amount of time may be preset and may be accumulated via an independent clock signal separate from the output enable signal 98 (e.g., internally generated in the LS 54 via a clock or received from an external clock by the LS 54). In step 166, when the amount of time 100 has expired, the LS 54 may compare the value of the counter with a output enable signal limit value that may be, for example, a preset value stored in memory in (or accessible by) the LS 54. In this manner, it may be determined whether the number of multiple gate clock timing signal 96 "on" pulses match the number of lines present in the display 12 for a refresh period of the display 12.

In step 168, if the counter value is less than or equal to the preset limit value, no fault signal is transmitted from the output 80 of the LS 54 to the TCON 52 in step 170 and the LS 54 may restart the process illustrated by flow chart 160. However, if the counter value is greater than the preset limit value in step 168, a fault signal (e.g., indication 90) is transmitted from the output 80 of the LS 54 to the TCON 52 in step 172. Additionally, the LS 54 may enter a safe mode in step 174 whereby all outputs transmitted from LS 54 along data lines 58 are set to one or more predetermined values. These values may continue to be transmitted from the LS 54 until a clear or reset signal is received from the TCON 52 at input 84, in step 176. Subsequent to receipt of this clear or reset signal, the LS 54 may restart the process illustrated by flow chart 160. Moreover, it should be noted that the process illustrated by flow chart 160 may be implemented utilizing the output enable signal 98 in place of the gate clock timing signal 96.

As described above, the LS 54 may utilize multiple measurements to determine whether received signals from the TCON 52 are invalid timing signals. While the above description was set forth as the LS 54 performing the testing of the timing signals of the TCON 52, it may be appreciated that the LS 54 may not be utilized in all displays 12. In such embodiments, a separate timing test circuit may be utilized in place of the LS 54 in FIG. 6. This timing test circuit may be, for example, a complex programmable logic device (CPLD), a field-programmable gate array (FPGA), an application-specific integrated circuit (ASIC), or other integrated circuit and may perform all testing functions described above with respect to FIGS. 9-15. Additionally, the TCON 52 may internally perform the all testing functions described above with respect to FIGS. 9-15 in place of the LS 54. That is, the testing may be performed internal to the TCON 52 prior to any timing signal being transmitted along path 56 either to LS 54 or directly to path 58.

Figure 16:
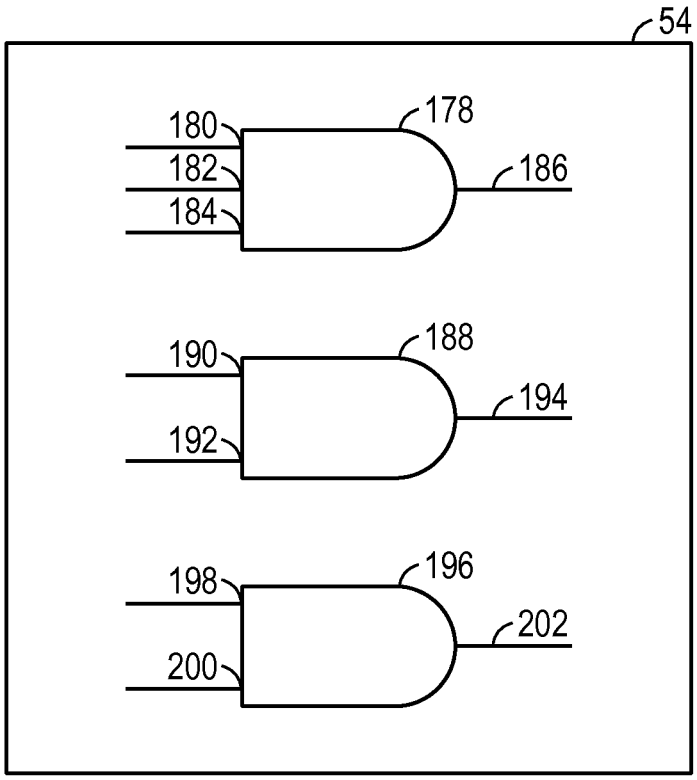
FIG. 16 is a block diagram illustrating elements of the display of the electronic device of FIG. 1, in accordance with an embodiment.

In some embodiments, logic gates may be employed to performing the testing of the timing signals of the TCON 52. This logic gates may be located in the LS 54, in timing test circuit, or in the TCON 52. FIG. 16 illustrates an example of logic gates that may be used and will be described as being present in the LS 54. However, as noted above, these elements may be located wherever the timing signals of the TCON 52 are tested.

FIG. 16 illustrates a first AND gate 178. AND gate 178 may have input 180 that receives the start of frame signal 94. The AND gate 178 may also include input 182 that receives a mask signal that may be related to the determination made in step 132 of FIG. 13. Likewise, the AND gate 178 may have an input 184 that receives an indication of any detected fault from step 118 of FIG. 12, step 136 of FIG. 13, step 154 of FIG. 14, and step 172 of FIG. 15. Based on the signals received at inputs 180, 182, and 184, the AND gate 186 may output the start of frame signal 94, for example, to path 58 or an indication that an invalid timing signal was detected (e.g., a safe value such as 0) to path 58.

FIG. 16 also illustrates a second AND gate 188. AND gate 188 may have input 190 that receives the gate clock timing signal 96. The AND gate 188 may also include input 192 that receives an indication of any detected fault from step 118 of FIG. 12, step 136 of FIG. 13, step 154 of FIG. 14, and step 172 of FIG. 15. Based on the signals received at inputs 190 and 192, the AND gate 188 may output the gate clock timing signal 96, for example, to path 58 or an indication that an invalid timing signal was detected (e.g., a safe value such as 0) to path 58.

FIG. 16 also illustrates a third AND gate 196. AND gate 196 may have input 198 that receives the output enable signal 98. The AND gate 178 may also include input 200 that receives an indication of any detected fault from step 118 of FIG. 12, step 136 of FIG. 13, step 154 of FIG. 14, and step 172 of FIG. 15. Based on the signals received at inputs 190 and 192, the AND gate 188 may output the output enable signal 98, for example, to path 58 or an indication that an invalid timing signal was detected (e.g., a safe value such as 0) to path 58.

Utilizing the devices and techniques outlined above, potential damage that may be caused by invalid timing signals being transmitted to a display may be reduced. Indeed, the devices and techniques described above allow for both notification of invalid timing signals as well as proactive steps to reduce the chance that invalid timing signals may damage a display. In this manner, the above description provides advantages over traditional displays.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A system, comprising:

a display configured to display an image;

a timing controller configured to generate timing signals related to the display of the image; and a level shifter configured to:

receive the timing signals;

determine if the timing signals are invalid; and transmit a fault indication when the timing signals are determined to be invalid, wherein the level shifter is configured to receive a gate clock timing signal related to a number of lines of the display as one of the timing signals.

2. The system of claim 1, wherein the level shifter is configured to receive a start of frame signal related to a refresh rate of the display as one of the timing signals.

3. The system of claim 2, wherein the level shifter is configured to determine if the timing signals are invalid by comparing the start of frame signal to a threshold value related to an expected value for the start of frame signal.

4. The system of claim 3, wherein the level shifter is configured to generate the fault indication based upon the comparison of the start of frame signal and the threshold value.

5. The system of claim 1, wherein the level shifter is configured to determine if the timing signals are invalid by comparing the gate clock timing signal to a threshold value related to an expected value for the gate clock timing signal.

6. The system of claim 5, wherein the level shifter is configured to generate the fault indication based upon the comparison of the gate clock timing signal and the threshold value.

7. The system of claim 1, wherein the level shifter is configured to receive an output enable signal related to refreshing the display with source driver data as one of the timing signals.

8. The system of claim 7, wherein the level shifter is configured to determine if the timing signals are invalid by comparing the output enable signal to a threshold value related to an expected value for the output enable signal.

9. The system of claim 8, wherein the level shifter is configured to generate the fault indication based upon the comparison of the output enable signal and the threshold value.

10. A device, comprising:

a timing test circuit configured to:

receive a timing signal related to display of an image on a display;

determine if the timing signal is invalid; and transmit a fault indication when the timing signal is determined to be invalid, wherein the timing test circuit is configured to determine if the timing signal is invalid by comparing an actual amount of time the timing signal is in a particular state with a threshold value related to an expected amount of time the timing signal is in the particular state, wherein the timing test circuit is configured to truncate the timing signal to generate a truncated signal having an amount of time in the particular state equal the expected amount of time the timing signal is in the particular state when the actual amount of time the timing signal is in a particular state exceeds the threshold value.

11. The device of claim 10, wherein the timing test circuit comprises an enable input configured to activate truncate functionality of a level shifter.

12. The device of claim 10, wherein the timing test circuit is configured to determine if the timing signal is invalid by comparing an actual number of pulses of the timing signal with a threshold value related to an expected number of pulses of the timing signal.

13. The device of claim 10, wherein the timing test circuit is configured to transmit a safe mode signal to the display to generate a predetermined image on the display when the timing signal is determined to be invalid.

14. The device of claim 10, wherein the timing test circuit comprises a level shifter configured to amplify the received timing signal to a voltage level suitable to drive pixels of the display.

15. A method, comprising:

generating a timing signal related to display of an image on a display;

determining if the timing signal is invalid based upon a comparison of the timing signal with a predetermined threshold value;

transmitting a fault indication when the timing signal is determined to be invalid, wherein determining if the timing signal is invalid comprises comparing an actual amount of time the timing signal is in a particular state with the threshold value; and truncating the timing signal to generate a truncated signal having an amount of time in the particular state equal an expected amount of time the timing signal is in the particular state.

16. The method of claim 15, wherein determining if the timing signal is invalid comprises comparing an actual number of pulses of the timing signal with the threshold value.

17. The method of claim 15, comprising transmitting a safe mode signal to the display to generate a predetermined image on the display when the timing signal is determined to be invalid.

* * * * *